US009427768B2

(12) United States Patent
Varga

(10) Patent No.: US 9,427,768 B2
(45) Date of Patent: Aug. 30, 2016

(54) ADHESIVE DISPENSING SYSTEM AND METHOD WITH MELT ON DEMAND AT POINT OF DISPENSING

(71) Applicant: Nordson Corporation, Westlake, OH (US)

(72) Inventor: Leslie J. Varga, Cumming, GA (US)

(73) Assignee: NORDSON CORPORATION, Westlake, OH (US)

( * ) Notice: Subject to any disclaimer, the term of this patent is extended or adjusted under 35 U.S.C. 154(b) by 297 days.

(21) Appl. No.: 13/790,118

(22) Filed: Mar. 8, 2013

(65) Prior Publication Data

US 2014/0117049 A1 May 1, 2014

Related U.S. Application Data

(60) Provisional application No. 61/718,976, filed on Oct. 26, 2012.

(51) Int. Cl.
*B67D 7/80* (2010.01)
*B05C 11/10* (2006.01)

(52) U.S. Cl.
CPC ..... *B05C 11/1042* (2013.01); *B05C 11/1034* (2013.01)

(58) Field of Classification Search
CPC . B05C 11/1042; B05C 11/1034; B05C 9/14; B05C 5/001
USPC ..... 222/145.6; 219/634
See application file for complete search history.

(56) References Cited

U.S. PATENT DOCUMENTS

| | | | |
|---|---|---|---|
| 3,826,224 | A | 7/1974 | Baker et al. |
| 4,441,450 | A | 4/1984 | Dettelbach et al. |
| 4,474,311 | A | 10/1984 | Petrecca |
| 4,516,700 | A | 5/1985 | Guzowski |
| 4,527,717 | A | 7/1985 | Emoto et al. |

(Continued)

FOREIGN PATENT DOCUMENTS

| | | |
|---|---|---|
| DE | 69609071 T2 | 3/2001 |
| EP | 0839116 A1 | 5/1998 |

(Continued)

OTHER PUBLICATIONS

European Patent Office, European Search Report in EP Application No. 13187931, Feb. 26, 2014.

(Continued)

*Primary Examiner* — Nichols J Weiss
(74) *Attorney, Agent, or Firm* — Baker & Hostetler LLP

(57) ABSTRACT

An adhesive dispensing system and method are configured to melt adhesive on demand and maintain the adhesive in a liquid state between dispensing cycles. The dispensing system includes a dispensing applicator with a manifold passage, a receiving device including a receiving chamber for holding a small amount of solid adhesive at the dispensing applicator and a first heating device for melting the adhesive on demand, and a second heating device at the manifold to maintain the temperature of the melted adhesive before dispensing. The receiving device is positioned adjacent to or partially nested within a manifold of the dispensing applicator such that the melted adhesive is delivered directly into the dispensing applicator. The second heating device applies heat energy to maintain the adhesive in the manifold passage as a liquid.

13 Claims, 5 Drawing Sheets

(56) References Cited

U.S. PATENT DOCUMENTS

| | | | | |
|---|---|---|---|---|
| 4,534,493 | A | | 8/1985 | Sedran |
| 4,784,582 | A | | 11/1988 | Howseman, Jr. |
| 4,898,527 | A | | 2/1990 | Claassen |
| 5,584,419 | A | | 12/1996 | Lasko |
| 5,680,963 | A | * | 10/1997 | Brusko et al. ..... 222/146.5 |
| 5,715,972 | A | | 2/1998 | Siddiqui |
| 5,747,102 | A | | 5/1998 | Smith et al. |
| 5,875,922 | A | | 3/1999 | Chastine et al. |
| 5,924,607 | A | | 7/1999 | Yamada et al. |
| 6,202,892 | B1 | | 3/2001 | Lasko |
| 6,223,950 | B1 | | 5/2001 | Lasko |
| 6,230,936 | B1 | | 5/2001 | Lasko |
| 6,253,957 | B1 | | 7/2001 | Messerly et al. |
| 6,799,702 | B1 | | 10/2004 | Mercer et al. |
| 7,626,143 | B2 | | 12/2009 | Miller |
| 7,755,009 | B2 | | 7/2010 | Lasko |
| 7,785,673 | B2 | | 8/2010 | Lasko |
| 7,886,935 | B2 | | 2/2011 | Lasko |
| 7,980,197 | B2 | | 7/2011 | Prentice et al. |
| 8,080,117 | B1 | | 12/2011 | Lasko |
| 8,167,516 | B2 | | 5/2012 | Lasko |
| 8,201,717 | B2 | | 6/2012 | Varga et al. |
| 2004/0118865 | A1 | | 6/2004 | Maruyama et al. |
| 2005/0230423 | A1 | | 10/2005 | Riney et al. |
| 2005/0236438 | A1 | | 10/2005 | Chastine et al. |
| 2006/0182887 | A1 | | 8/2006 | Miller |
| 2008/0190365 | A1 | | 8/2008 | Lasko |
| 2008/0191391 | A1 | | 8/2008 | Lasko |
| 2008/0205998 | A1 | | 8/2008 | Lasko |
| 2009/0261121 | A1 | | 10/2009 | Varga |
| 2010/0270289 | A1 | | 10/2010 | Lasko |
| 2011/0142552 | A1 | | 6/2011 | Lasko |
| 2011/0300295 | A1 | | 12/2011 | Clark et al. |
| 2012/0018425 | A1 | | 1/2012 | Lasko |
| 2012/0312838 | A1 | | 12/2012 | Clark et al. |

FOREIGN PATENT DOCUMENTS

| | | | |
|---|---|---|---|
| EP | 1802191 | A2 | 6/2007 |
| EP | 2119509 | A2 | 11/2009 |
| GB | 2457220 | A | 8/2009 |
| JP | S58-050910 | U | 4/1983 |
| JP | H09-220504 | A | 8/1997 |
| JP | 2000-033322 | A | 2/2000 |
| JP | 2002-513674 | A | 5/2002 |
| JP | 2004-141866 | A | 5/2004 |
| WO | 9635636 | A1 | 11/1996 |
| WO | 99/56889 | A1 | 11/1999 |
| WO | 00/62941 | A1 | 10/2000 |
| WO | 2007084891 | A2 | 7/2007 |
| WO | 2011087961 | A1 | 7/2011 |

OTHER PUBLICATIONS

Nordson Corporation, AD-25 Hand Gun, Brochure, Oct. 1976.

Meltex GmbH, Hot Melt Applicator MX 2003, Brochure, May 1989.

Meltex Corporation, Hot Melt Applicator MP 400, Brochure, undated-material predates at least 2004.

Meltex GmbH, Hot Melt Appilcator MX 2001, Brochure, May 1989.

U.S. Patent and Trademark Office, International Search Report and Written Opinion in PCT Application Serial No. PCT/US2011/020489, Mar. 1, 2011, 10 pages.

U.S. Patent and Trademark Office, lnternational Preliminary Report on Patentability in PCT Application Serial No. PCT/US2011/020489, May 16, 2012, 17 pages.

Robatech AG, ACX 100 Series, Applicator heads for coldglue, 2 pgs., undated.

Robatech AG, SX Series, Applicator heads for Hotmelts, 4 pgs., undated.

Australian Patent Office. Patent Examination Report No. 1 in Australian Application No. 2011205506, Mar. 8, 2013, 4 pages.

European Patent Office, Extended European Search Report in EP Application No. 11733219, Feb. 13, 2014, 10 pages.

Japanese Patent Office, Notification of Reason for Rejecton in JP Application No. 2012-548980, Aug. 21, 2014, 8 pages.

* cited by examiner

ADHESIVE DISPENSING SYSTEM AND METHOD WITH MELT ON DEMAND AT POINT OF DISPENSING

CROSS-REFERENCE TO RELATED APPLICATION

This application claims the benefit of U.S. Provisional Patent Application Ser. No. 61/718,976, filed on Oct. 26, 2012, the disclosure of which is incorporated by reference herein in its entirety.

FIELD OF THE INVENTION

The present invention generally relates to an adhesive dispensing system, and more particularly, to adhesive dispensing systems and methods using a receiving device for melting adhesive at the point of dispensing.

BACKGROUND

A conventional system for dispensing heated adhesive (i.e., a hot-melt adhesive dispensing system) generally includes a melter having a tank or reservoir for receiving adhesive materials in solid or liquid form, a heater grid for heating and/or melting the adhesive materials in the tank or reservoir, and a pump in communication with the heater grid and the tank or reservoir for driving and controlling the dispensation of the heated adhesive from the melter to downstream dispensing guns or modules. One or more hoses may also be connected to the melter to direct the dispensation of heated adhesive to the adhesive dispensing guns or modules located downstream from the pump. Furthermore, conventional dispensing systems generally include a controller (e.g., a processor and a memory) and input controls electrically connected to the controller to provide a user interface with the dispensing system and to control the various components of the dispensing system.

Conventional hot-melt adhesive dispensing systems typically operate at ranges of temperatures sufficient to melt the received adhesive and heat the adhesive to an elevated application temperature prior to dispensing the heated adhesive. As adhesive throughput requirements increase (e.g., up to 20 lb/hour or more), adhesive dispensing systems have traditionally increased the size of the tank or reservoir used with the melter to ensure that the maximum desired flow of molten adhesive can be supplied. However, large tanks and reservoirs result in a large amount of hot-melt adhesive being held at the elevated application temperature within the adhesive dispensing system. During periods of operation when the adhesive dispensing system is not operating at a maximum throughput, large amounts of hot-melt adhesive may be held at the elevated application temperature within the tank or reservoir for significant lengths of time, which can lead to degradation and/or charring of the adhesive, negative effects on the bonding characteristics of the adhesive, clogging of the adhesive dispensing system, and/or additional downtime. Furthermore, the provision of heated hoses extending from the melter to the dispensing modules further increases the complexity and expense of the adhesive dispensing system, while also further increasing the time that the adhesive is held at the elevated application temperature.

In several other conventional adhesive dispensing systems, the tank or reservoir of the melter has been reduced in size or nearly eliminated by providing a different type of melter configured to melt adhesive on demand when required by the dispensing modules (referred to as "melt on demand"). By using melt on demand, some of the problems associated with holding the adhesive at the elevated application temperature for long periods of time are reduced in significance, including but not limited to, charring and degradation. One example of such a melt on demand process is described in U.S. Pat. No. 6,230,936 to Lasko. Although systems such as the one shown in the Lasko patent melt adhesive on an as-needed basis, these systems continue to suffer from re-solidification of adhesive when used during periods of low throughput. It is highly impractical or impossible to expel clogs of re-solidified adhesive from the system when these clogs occur. In addition, the conversion efficiency of the energy applied to the adhesive is lowered by the problems experienced with these systems.

For reasons such as these, an improved hot-melt adhesive dispensing system that maximizes energy conversion efficiency while using melt on demand would be desirable.

SUMMARY OF THE INVENTION

According to one embodiment of the current invention, an adhesive dispensing system is provided for melting adhesive on demand and dispensing the adhesive. The dispensing system includes a dispensing applicator having a manifold with a manifold passage and a dispensing module coupled to the manifold passage. The dispensing system also includes a receiving device positioned proximate to the dispensing applicator. The receiving device includes a receiving chamber for receiving a small amount of solid adhesive at the location of the dispensing applicator. The receiving device also includes an outlet positioned to deliver melted adhesive into the manifold immediately after melting. A first heating device is positioned proximate to the manifold and to the receiving device, and the first heating device rapidly melts the adhesive on demand. A second heating device positioned within the manifold applies heat energy to maintain the adhesive as a liquid in the manifold passage. The operation of the first and second heating devices prevents re-solidification of the melted adhesive.

In one aspect, the first heating device may include an induction coil and a susceptor that is actuated electromagnetically by the induction coil to heat up and thereby apply heat energy to rapidly melt the adhesive. Alternatively, the first heating device may include a heater unit in the form of a heater grid defining a plurality of openings and including a heating element that heats the adhesive moving through the plurality of openings. In another embodiment, the manifold includes a cartridge receptacle and the receiving device is a cartridge filled with solid adhesive. The cartridge is inserted into the cartridge receptacle so that the solid adhesive may be melted by the first heating device. In each of these alternatives, as well as other arrangements for the first heating device, the adhesive is melted and then discharged immediately into the manifold for use by the dispensing applicator. For example, the receiving device may nest at least partially into the manifold such that the outlet is positioned within the manifold. In another example, the receiving device may be coupled to the manifold such that the outlet is positioned to feed directly into the manifold passage.

The first heating device may be located in various different locations within the adhesive dispensing system. For example, the first heating device is located within the manifold in some embodiments. In other embodiments, the first heating device is located within the receiving device. Alternatively, the first heating device may be divided into a first portion in the receiving device and a second portion in the manifold. In the example including an induction coil and a susceptor discussed above, the susceptor would be located within the receiving device and the induction coil would be located within the manifold. Regardless of where the first heating device is located, the first heating device remains positioned to rapidly heat and melt the solid adhesive in the receiving device so that the melted adhesive flows into the dispensing applicator.

In another aspect, the second heating device may include a heater cartridge extending through the manifold and heating the manifold and the manifold passage. The second heating device may also include etched resistance heaters located adjacent to the manifold passage. More particularly, the etched resistance heaters may define at least a portion of the sidewall of the manifold passage so that adhesive flows past the etched resistance heaters to receive heat energy. The dispensing applicator may include any type of dispensing module for discharging the melted adhesive onto a substrate. To this end, the dispensing applicator may include a jetting module that operates to rapidly jet minute droplets of melted adhesive onto the substrate. In another example, the dispensing applicator may include a metering pump that feeds one or more dispensing modules. Consequently, the melted adhesive does not solidify downstream from the first heating device, and purging of solid material from the dispensing applicator is rendered unnecessary.

In another embodiment according to the invention, a method for dispensing an adhesive uses an adhesive dispensing system having a dispensing applicator with a manifold including a manifold passage and also having a receiving device. Solid adhesive is supplied to the receiving device and rapidly heated with a first heating device. As a result, the adhesive is melted rapidly on demand when needed for dispensing. The method also includes delivering the melted adhesive directly from the receiving device into the manifold. A second heating device applies heat energy to maintain the adhesive as a liquid within the manifold. The dispensing applicator then dispenses the melted adhesive. The method provides melting of adhesive on demand while avoiding the problems of charring or solidification.

These and other objects and advantages of the invention will become more readily apparent during the following detailed description taken in conjunction with the drawings herein.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF THE ILLUSTRATIVE EMBODIMENTS

Figure 1:
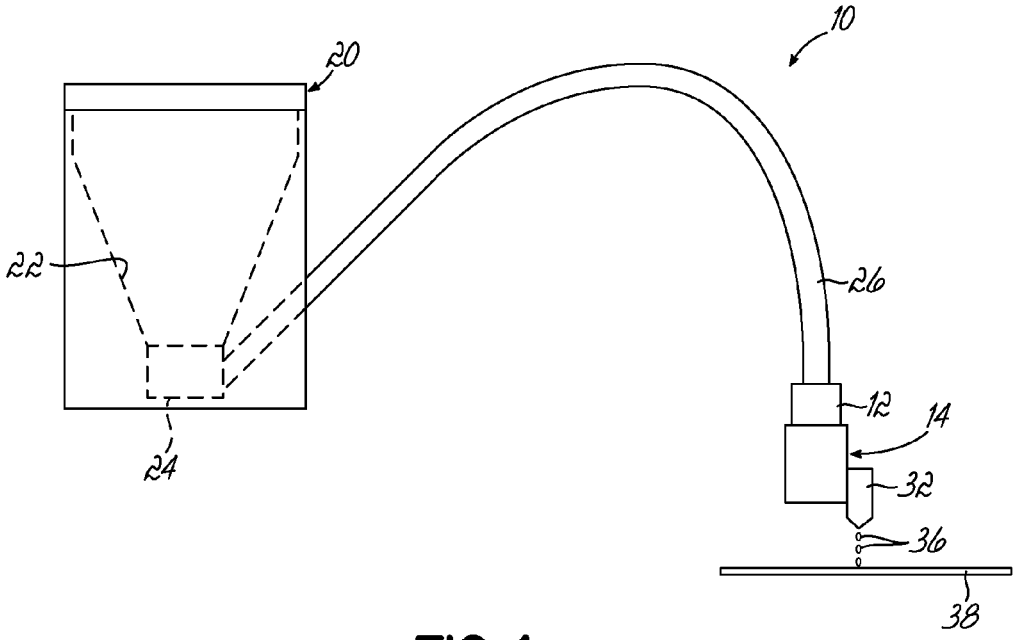
FIG. 1 is a schematic view of an exemplary embodiment of an adhesive dispensing system with melt on demand according to the current invention.
Figure 2:
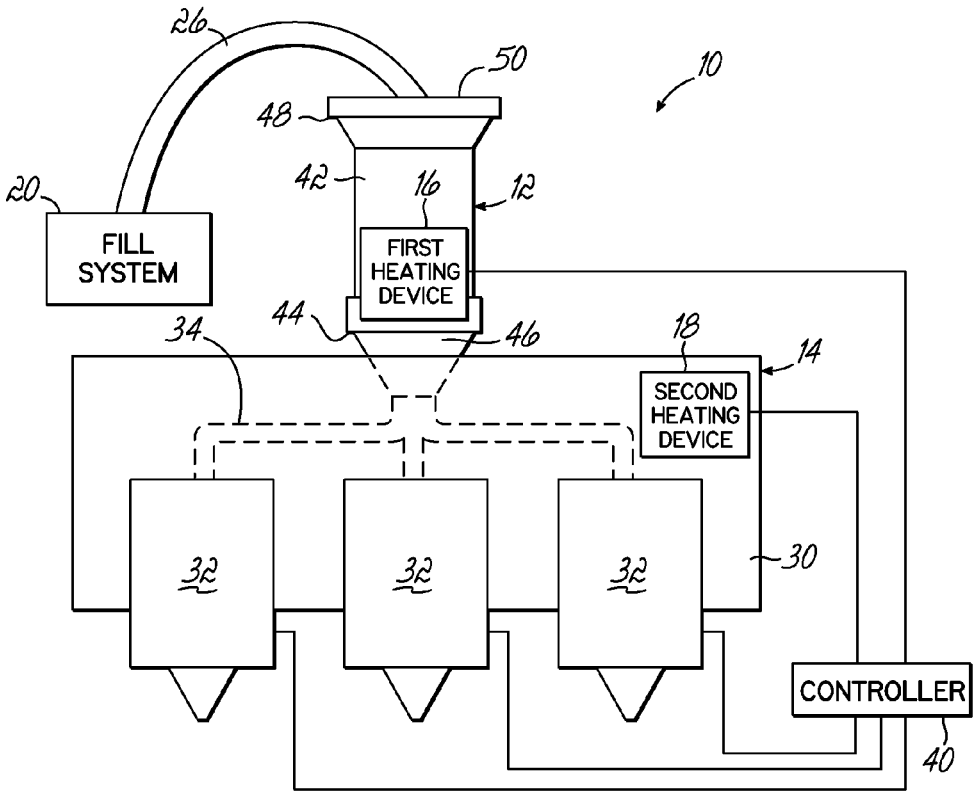
FIG. 2 is a schematic front view of the adhesive dispensing system of FIG. 1, the system including multiple dispensing modules supplied by a receiving device.
Figure 3:
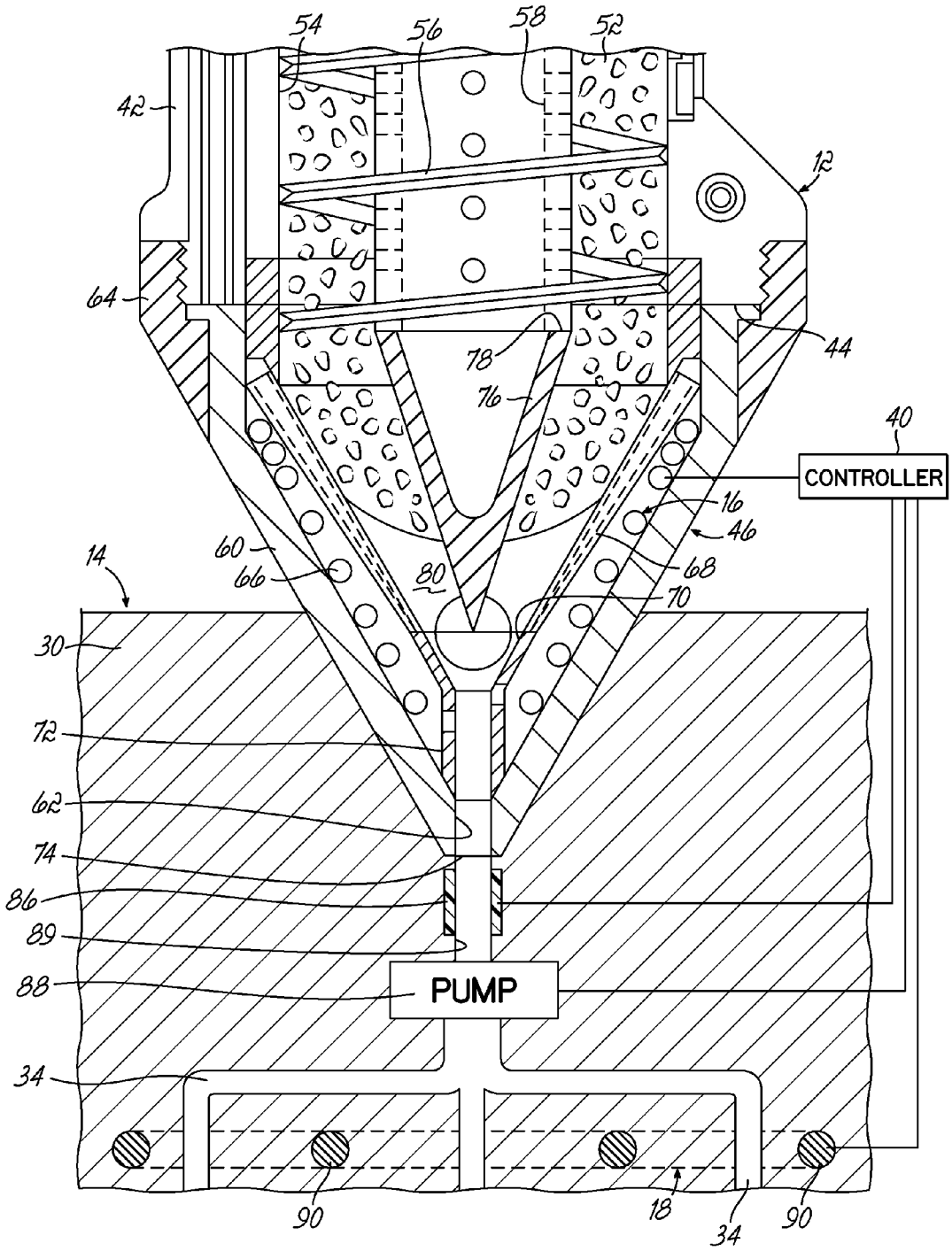
FIG. 3 is a cross-sectional front view of the receiving device and the manifold of the adhesive dispensing system of FIG. 2.

Referring to FIGS. 1 through 3, an adhesive dispensing system 10 in accordance with one exemplary embodiment of the invention is shown. The adhesive dispensing system 10 is configured to improve the dispensing operation by using a melt on demand process at the point of dispensing to melt solid adhesive material rapidly when that material is needed for dispensing. To this end, the storage of molten hot melt adhesive at elevated temperatures in reservoirs, tanks, and/or heated hoses located remote from the point of dispensing is substantially eliminated from the adhesive dispensing system 10, and the likelihood for degradation and/or charring of the adhesive is reduced significantly as a result. Moreover, the adhesive does not require transport or pumping over lengthy distances between the point of melting and the point of dispensing because the melting occurs at the point of dispensing. In other words, a receiving device 12 of the adhesive dispensing system 10 is located at the same location as a dispensing applicator 14. The adhesive is advantageously melted by a first heating device 16 located proximate to the receiving device 12 and then kept in the liquid state by a second heating device 18 included within the dispensing applicator 14. As a result, the adhesive is rapidly melted on demand when needed for dispensing and kept at an elevated temperature in a liquid state downstream from the receiving device 12 to prevent re-solidification of the adhesive. Therefore, the adhesive dispensing system 10 reduces or eliminates problems with re-solidification of adhesive while also being more energy efficient as a result of the melt on demand process.

With reference to FIG. 1, a schematic layout of the exemplary embodiment of the adhesive dispensing system 10 is illustrated. To this end, the dispensing system 10 includes the dispensing applicator 14 and receiving device 12 previously described, as well as a fill system 20 configured to supply solid adhesive to the receiving device 12. The fill system 20 can take any number of known forms, but the fill system 20 of the exemplary embodiment in FIG. 1 includes a hopper 22 with a solids pump 24 and a hose 26 extending from the hopper 22 to the receiving device 12. The hopper 22 may include a large storage tote configured to store solid particulate adhesive such as pelletized adhesive for periodic delivery to the receiving device 12. The solids pump 24 may include a pneumatic pump having an eductor and/or a venturi (not shown) to move solid adhesive from the hopper 22 with pressurized air through the hose 26 to the receiving device 12. It will be understood that the solids pump 24 may include other types of feeding mechanisms, including non-pneumatic forms of feeding such as a mechanical agitator, in other embodiments consistent with the scope of the invention. The hopper 22 may be repositioned adjacent to the receiving device 12 as well in other embodiments.

As shown in FIGS. 1 and 2, the fill system delivers the solid adhesive material to the receiving device 12, which is located adjacent to the dispensing applicator 14 so that the receiving device 12 can store a small amount of solid adhesive for melting on demand, such as needed for dispensing. The first heating device 16 is schematically shown within the receiving device 12, but it will be understood that the first heating device 16 may be located within the dispensing applicator 14 or be divided into portions in each of the receiving device 12 and the dispensing applicator 14 in other embodiments. The dispensing applicator 14 of the exemplary embodiment includes a manifold 30 and a plurality of dispensing modules 32 coupled to the manifold 30. The manifold 30 is configured to receive melted adhesive material from the receiving device 12 and supply that melted adhesive to the dispensing modules 32. To this end, the manifold 30 may include a manifold passage 34 that extends internally through the manifold 30 between the receiving device 12 and the dispensing modules 32. The manifold passage 34 may be heated by the second heating device 18 to maintain the adhesive in the manifold 30 in the molten liquid state at the elevated temperature, thereby preventing solidification of the adhesive. It will be understood that the dispensing applicator 14 may be modified in other embodiments. For example, the manifold 30 may be incorporated into one or more dispensing modules 32, or the manifold 30 may be omitted in other embodiments depending on the particular type of dispensing applicator 14 required for dispensing the adhesive.

As well understood, the dispensing modules 32 include flow valves configured to actuate selective control over the dispensing of the adhesive. The dispensing modules 32 may include any known type of dispensing module 32 used to dispense various types of adhesive materials onto substrates. In one example, the dispensing modules 32 include the jetting module described in co-pending U.S. Patent Publication No. 2011/0300295 to Clark et al., which is co-owned by the assignee of the current application, and the disclosure of which is hereby incorporated by reference in its entirety herein. To this end, the dispensing module 32 operates to rapidly open and close a valve member against a valve seat (not shown) to repeatedly permit flow of the adhesive towards a dispensing outlet and then force minute droplets 36 of the adhesive from the dispensing outlet and onto a substrate 38 as shown schematically in FIG. 1. Therefore, the dispensing modules 32 may operate to rapidly jet minute droplets of the adhesive from the dispensing applicator 14. It will be appreciated that other types of dispensing applicators, including similar and different types of contact or non-contact nozzles/modules, may be used without departing from the scope of the invention.

The adhesive dispensing system 10 may also include a controller 40 configured to operate the various components of the receiving device 12 and the dispensing applicator 14. To this end, the controller 40 operates the first and second heating devices 16, 18 to provide melt on demand to the dispensing modules 32. In one example, the controller 40 receives input corresponding to an actuation of dispensing at one or more of the dispensing modules 32 and then actuates the first heating device 16 to rapidly melt and supply more molten adhesive to the manifold 30. As shown schematically in FIG. 3, this input to the controller 40 may be module actuation signals sent directly from the dispensing modules 32, but this input could also include other alternatives such as a level sensor detecting removal of adhesive from at least some portion of the manifold passage 34. As a result, whenever the dispensing modules 32 operate to dispense adhesive material supplied from the manifold 30, the controller 40 operates the first and second heating devices 16, 18 to melt more adhesive and maintain a small supply of adhesive at the elevated temperature within the manifold passage 34 for use by the dispensing modules 32. It will be understood that the controller 40 may be connected to additional components such as the fill system 20 and may also operate to control additional operational features of the adhesive dispensing system 10, including but not limited to: refill of the receiving device 12 with the fill system 20, and actuation of the dispensing modules 32 to dispense molten adhesive. In this regard, the arrangement of components of the adhesive dispensing system 10 and the operation of the controller 40 and the first and second heating devices 16, 18 collectively minimizes the heat energy applied to enable dispensing of adhesive at an elevated temperature.

With particular reference to FIG. 3, further details of the receiving device 12 and the manifold 30 of the exemplary embodiment are shown. More specifically, the receiving device 12 of this embodiment includes the first heating device 16 for rapidly heating and melting the adhesive to an elevated temperature. One example of such a first heating device 16 could include an inductor/susceptor-type of heating device for rapidly melting the adhesive on demand for the dispensing applicator 14. Continuing with this example, the receiving device 12 may include many of the components described in U.S. Pat. No. 6,230,936 to Lasko, the disclosure of which is hereby incorporated by reference in its entirety herein. To this end, the receiving device 12 may include a body 42 including a distal end 44 connected to a nose assembly 46 and a proximal end 48 defining an inlet 50 (FIG. 2) for receiving the adhesive 52 in the form of beads, pellets, or other solid or semi-solid particulate from the hose 26. The body 42 therefore defines an internal receiving chamber 54 extending from the inlet 50 to the nose assembly 46 such that a small supply of solid adhesive 52 can be held in the receiving chamber 54 and fed towards the first heating device 16. A feed screw or auger 56 may be mounted on a screw barrel 58 located within the receiving chamber 54 and configured to actuate movement of adhesive 52 towards the nose assembly 46. In this regard, the feed screw 56 is driven by a motor (not shown) to rotate and force movement of the solid adhesive 52 downwardly in the orientation shown in FIG. 3. As described in further detail below, the driving movement of the feed screw 56 is controlled to correspond to the demands for adhesive 52 at the dispensing applicator 14, thereby causing the receiving device 12 to provide the desired amounts of molten adhesive 52 to the dispensing modules 32. Alternatively, it will be understood that the feed screw 56 and screw barrel 58 may be omitted in other embodiments such that the solid adhesive 52 is gravity-fed to the bottom of the receiving chamber 54 and into the nose assembly 46 for melting by the first heating device 16. Other types of agitators for moving the solid adhesive 52 may also be used without departing from the scope of the invention.

With continued reference to FIG. 3, the nose assembly 46 includes a conical housing cone 60 having a central orifice 62. The conical housing cone 60 may be coupled to the distal end 44 of the body 42 with a threaded collar 64 or a similar connection mechanism. It will be appreciated that the nose assembly 46 may alternatively be integrally formed with the body 42 (e.g., as the bottom end of the body 42) or may be reshaped in other ways (e.g., non-tapered) in other embodiments of the receiving device 12. The nose assembly 46 also includes a conical inductor 66 received within the conical housing cone 60. The conical inductor 66 is an induction coil of wire that may be supplied with electrical current to electromagnetically induce heating of a conical susceptor 68 received within the conical inductor 66. The conical susceptor 68 may be corrugated or bent to increase the effective surface area facing the adhesive 52 in the conical housing cone 60. The conical susceptor 68 also includes a central orifice 70 aligned with the central orifice 62 in the conical housing cone 60 such that melted adhesive can flow through an outlet 74 of the receiving device 12 defined at the central orifice 62 of the conical housing cone 60. A stationary inner cone 76 is also located within the conical housing cone 60 and is connected at a sliding joint 78 to the end of the screw barrel 58 at the distal end 44 of the body 42. Therefore, the conical housing cone 60 defines a melting passage 80 defined between the conical susceptor 68 and the stationary inner cone 76 and extending from the receiving chamber 54 of the body 42 to the outlet 74. The melting passage 80 receives adhesive 52 driven out of the receiving chamber 54 by the feed screw 56 or otherwise fed by gravity or other agitators out of the receiving chamber 54, and the susceptor 68 rapidly melts the solid adhesive 52 into a molten state within the melting passage 80 before the adhesive 52 passes through the outlet 74 and into the manifold 30.

The receiving device 12 of this embodiment is positioned such that the nose assembly 46 nests at least partially into the manifold 30 of the dispensing applicator 14. As a result, the outlet 74 is located within the manifold 30 such that the outlet 74 discharges molten adhesive 52 directly and immediately into the manifold passage 34 after melting of the adhesive 52 within the melting passage 80. As described in further detail below, the manifold 30 may also be heated such that the nesting of the nose assembly 46 into the heated manifold 30 provides additional heat energy at the nose assembly 46 for melting the adhesive 52. To this end, at least a portion of the first melting device 16 may be located within the manifold 30 instead of within the receiving device 12. Alternatively, the nose assembly 46 may be reconfigured without a tapered shape or without the amount of nesting into the manifold 30 that is illustrated in FIG. 3, as long as the outlet 74 continues to discharge molten adhesive directly and immediately into the manifold passage 34 after melting. One example of such a non-tapered, non-nesting arrangement is described in further detail below with reference to the embodiment shown in FIG. 4. In another alternative example, a heater grid (not shown) may be formed from a plurality of susceptors arranged in a grid structure and induced by one or more inductors.

In operation, whenever the dispensing modules 32 require more adhesive 52 for dispensing as determined at the controller 40, the feed screw 56 is rotated to force solid adhesive 52 into the melting passage 80 for melting using heat energy generated by the electromagnetic inducement of the susceptor 68 with the induction coil 66. Additionally, the controller 40 may turn on or actuate heating at the susceptor 68 in response to the dispensing modules 32 requiring more adhesive 52 if the first heating device 16 had been previously turned off or placed into a standby mode. The heat energy applied by the susceptor 68 is tailored to rapidly melt the adhesive 52, but with gentle enough heating to avoid charring and degradation of the adhesive 52. When the dispensing modules 32 stop requesting more adhesive (e.g., dispensing operations are stopped), the feed screw 56 may be driven in reverse a short amount to remove the pressure that forces adhesive 52 into and through the melting passage 80. This reversal of flow may not be required in all embodiments of the invention, including other embodiments with gravity-fed solid adhesive 52 held in a receiving chamber 54 without a feed screw 56. It will be understood that the feed screw 56 may be driven with different speeds to provide various levels of molten adhesive throughput, depending on the requirements at the dispensing modules 32.

Advantageously, by locating the receiving device 12 at the dispensing applicator 14 and by optionally nesting the nose assembly 46 into the manifold 30, the adhesive 52 may be melted on demand and delivered to the dispensing modules 32 simply by flowing directly from the outlet 74 of the receiving device 12 into the manifold passage 34. Thus, no heated hoses or other conduits are required between the receiving device 12 and the dispensing applicator 14. Moreover, the melt on demand process enables molten adhesive 52 to be supplied to the dispensing modules 32 without necessitating the holding of a reservoir or tank full of adhesive at the elevated temperature at a location remote from the dispensing applicator 14. Consequently, the melt on demand process in the exemplary embodiment is energy efficient (e.g., a maximized percentage of the energy supplied to the dispensing system 10 is realized in the adhesive 52 dispensed from the applicator 14) and requires fewer components than other dispensing systems having hoses extending between separated melters and applicators. In addition, the elimination of a large reservoir or tank for holding molten adhesive at a location remote from the dispensing applicator 14 reduces the likelihood of charring or solidification of the adhesive.

Additionally, the manifold 30 is also configured to reduce the likelihood of charring or solidification of the adhesive. To this end, the manifold 30 includes the second heating device 18 described briefly above. The second heating device 18 may include one or more types of heating elements located within the manifold 30 and operable to maintain the temperature of the adhesive 52 flowing through the manifold passage 34. In the exemplary embodiment shown in FIG. 3, the second heating device 18 includes an etched resistance heater 86 positioned adjacent to the manifold passage 34. The etched resistance heater 86 may receive electrical current to generate and apply heat energy to the manifold passage 34 and any adhesive 52 located in the manifold passage 34. The etched resistance heater 86 may be positioned within the manifold 30 so that the etched resistance heater 86 defines at least a portion of the sidewalls defining the manifold passage 34. However, it will be understood that the etched resistance heater 86 may be repositioned in other embodiments, as long as the heat energy generated is delivered to the manifold passage 34.

The manifold 30 shown in FIG. 3 includes an optional metering pump 88 that meters the supply of molten adhesive 52 in the manifold passage 34 to the dispensing modules 32. To this end, the manifold passage 34 may branch into separate passage portions downstream from the optional metering pump 88 to divide the flow of adhesive 52 and supply each of the dispensing modules 32 associated with the dispensing applicator 14. This arrangement of the manifold passage 34 advantageously enables the receiving device 12 to supply multiple dispensing modules 32 with molten adhesive while using melt on demand. Although the etched resistance heater 86 is shown as positioned at a collection portion 89 of the manifold passage 34 located upstream from the pump 88, it will be appreciated that the etched resistance heater 86 may also be repositioned to directly heat the portions of the manifold passage 34 that branch off downstream from the pump 88 in other embodiments of the invention. It will be understood that the collection portion 89 is located upstream from the optional pump 88 (when included in the manifold 30) and upstream from the dispensing modules 32 to provide a small volume of molten adhesive from which the dispensing modules 32 can draw in order to conduct dispensing operations.

The second heating device 18 also includes a heater cartridge 90 in the exemplary embodiment shown in FIG. 3. The heater cartridge 90 extends through the manifold 30 and may include multiple passes running between the branches of the manifold passage 34 downstream from the metering pump 88. The heater cartridge 90 is inserted or cast into position within the manifold 30 and operates to heat the entire manifold 30 (or a substantial portion thereof), which then applies heat energy to the adhesive 52 in the manifold passage 34 to maintain the adhesive 52 at the elevated temperature. It will be understood that the etched resistance heater 86 or the heater cartridge 90 may be used alone rather than in combination in other embodiments of the dispensing system 10, and additional types of heaters may also be used in the second heating device 18 without departing from the scope of the invention. The application of heat energy to the adhesive 52 in the manifold 30 prevents re-solidification of the adhesive 52 downstream from the receiving device 12 during periods of low throughput or between dispensing cycles. Thus, the use of the second heating device 18, in combination with the first heating device 14, advantageously enables a melt on demand process configured to supply multiple dispensing modules 32 during periods of both high and low throughput. The problems of conventional dispensing systems with solidification of the adhesive are reduced or eliminated when using the adhesive dispensing system 10 of the current invention. The operation of the adhesive dispensing system 10 is therefore optimized for energy efficiency (e.g., a minimized amount of heat energy is applied to enable dispensing of adhesive 52 at the elevated temperature) and improved for melting at the point of demand.

Figure 4:
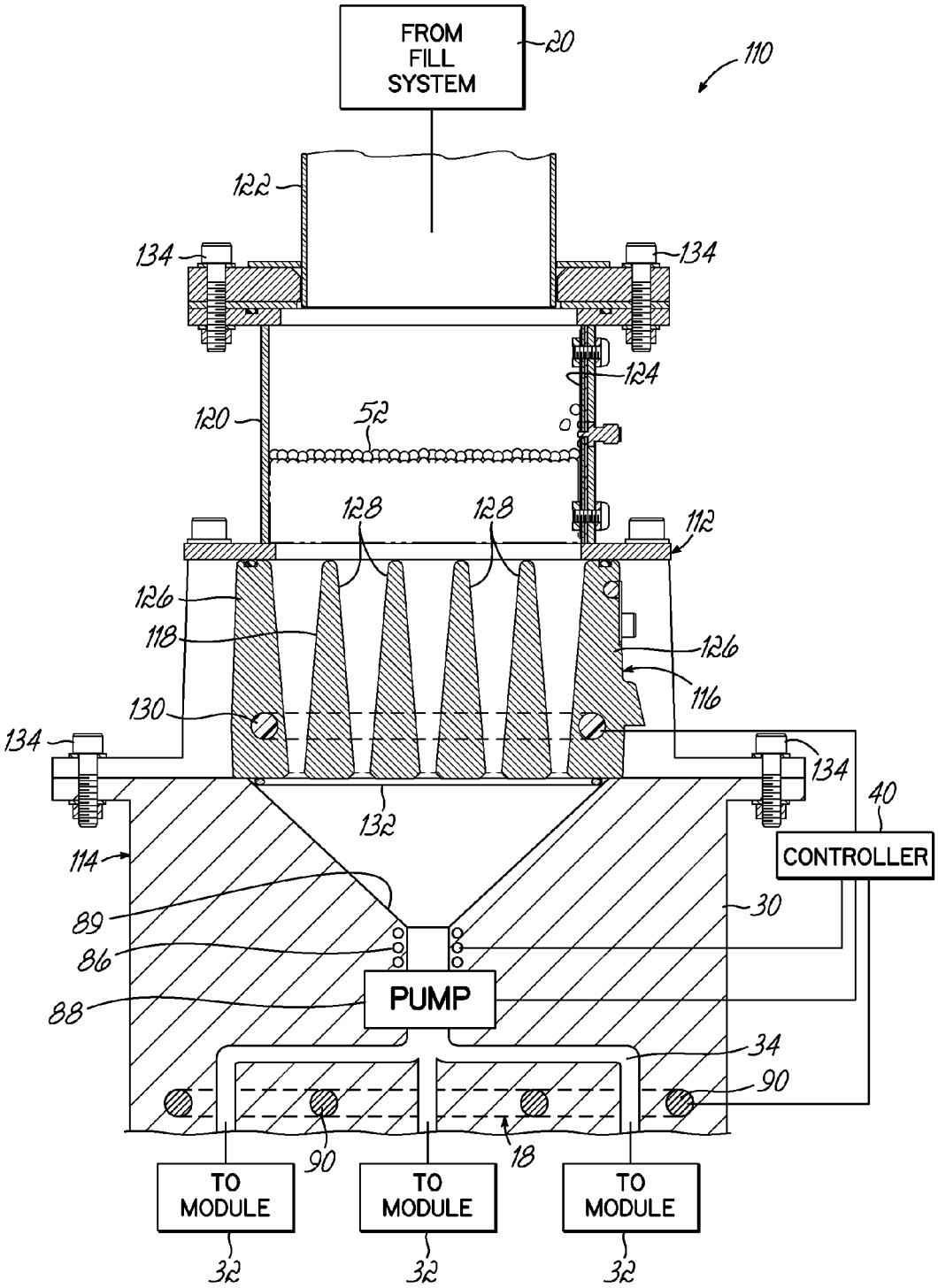
FIG. 4 is a cross-sectional front view of an alternative receiving device including a heater unit and manifold according to another embodiment of the adhesive dispensing system.

In another exemplary embodiment of the adhesive dispensing system 110 shown in FIG. 4, an alternative arrangement of a receiving device 112 and a dispensing applicator 114 are provided. Several of the components of this embodiment of the adhesive dispensing system 110 are identical or substantially similar to the components described above, and these components (for example, the manifold 30) have been marked with the same reference numbers in this embodiment without additional explanation below. In this embodiment, the receiving device 112 includes a first heating device 116 defined by a heater unit 118 in the form of a heater grid 118. Many of the components of the receiving device 112 of this embodiment are also described in co-pending U.S. Patent Application No. 61/703,454 to Clark et al., entitled "Adhesive Dispensing Device having Melt Subassembly with Optimized Reservoir and Capacitive Level Sensor" (Our Ref.: NOR-1496P), the disclosure of which is hereby incorporated by reference in its entirety herein. The receiving device 112 of this embodiment operates to store a small amount of solid adhesive 52 and provide molten adhesive 52 using melt on demand at the location of dispensing in a similar manner as described with reference to the embodiment of FIGS. 1 through 3.

To this end, the receiving device 112 includes the heater grid 118, a receiving chamber 120 located above the heater grid 118 and configured to supply solid particulate adhesive 52 into the heater grid 118, and an optional cyclonic separator unit 122 located above the receiving chamber 120 and configured to deliver the adhesive 52 from the fill system 20 and hose 26 into the receiving chamber 120. As described in further detail in the Clark application, the receiving chamber 120 may also include a level sensor 124 configured to sense the level of adhesive 52 within the receiving chamber 120 to ensure that the fill system 20 continually provides refills of solid adhesive 52 into the receiving device 112 as the adhesive 52 is dispensed by the dispensing applicator 114. The heater grid 118 includes a peripheral wall 126 and a plurality of partitions 128 extending across the space between the receiving chamber 120 and the manifold 30. The heater grid 118 therefore defines a plurality of openings 129 through the heater grid 118 and between the partitions 128 for flow of the adhesive 52. It will be understood that the plurality of openings 129 may be defined by different structure than grid-like partitions in other embodiments of the heater unit 118, including, but not limited to, fin-like structures extending from the peripheral wall 126, without departing from the scope of the invention. In this regard, the "heater unit" 118 may include a non grid-like structure for heating the adhesive 52 in other embodiments. The heater unit 118 (shown as heater grid 118 in this embodiment) can include any structure, as long as at least one opening 129 is provided for adhesive flow through the adhesive dispensing system 110.

The peripheral wall 126 is configured to receive a heater cartridge 130 or another equivalent heating element, which may be inserted or cast into the heater grid 118. The heater cartridge 130 applies heat energy to the heater grid 118, which is conducted through the peripheral wall 126 and the partitions 128 to transfer heat energy to the adhesive 52 flowing within the plurality of openings 129 and thereby rapidly melt the adhesive 52 on demand. The operation of the heater cartridge 130 and the heater grid 118 may be controlled by the controller 40 to melt adhesive 52 when required by dispensing operations at the dispensing applicator 114. Therefore, a minimized amount of heat energy is applied to enable dispensing of adhesive 52 at the elevated temperature. Similar to the previous embodiment, the controller 40 is coupled to one or more inputs such as the dispensing modules 32 as described in detail above. The receiving device 112 also defines an open bottom outlet 132 at the lower end of the openings 129 in the heater grid 118. The receiving device 112 is coupled to the manifold 30 of the dispensing applicator 114 (such as by threaded fasteners 134 or other similar connectors) so that this outlet 132 communicates directly with the manifold passage 34 (and more particularly, with the collection portion 89 of the manifold passage 34). Therefore, similar to the previous embodiment, the receiving device 112 includes an outlet 132 that immediately feeds adhesive 52 directly from the openings 129 in the heater grid 118 into the manifold passage 34 after melting at the heater grid 118.

The heater grid 118 and receiving chamber 120 are sized to be relatively small such that a minimal volume of adhesive 52 is held at an elevated temperature before use in the dispensing applicator 114. In this regard, there is no reservoir or tank of molten adhesive positioned remote from the receiving device 112 and dispensing applicator 114. As a result, the problems of adhesive charring are reduced or eliminated in this adhesive dispensing system 110. Similar to the previously described embodiment, the manifold 30 again includes a second heating device 18 that operates to apply heat energy to the melted adhesive 52 to maintain the melted adhesive 52 at the elevated temperature and in the liquid state downstream from the receiving device 112, thereby preventing re-solidification of the adhesive 52. The second heating device 18 may again include various types of heating elements, including, but not limited to, the etched resistance heater 86 (now shown within the manifold 30 adjacent to the manifold passage 34) and/or the heater cartridge 90 for heating the entire manifold 30. Therefore, the adhesive dispensing system 110 of this embodiment also enables the energy-efficient melt on demand operation with an advantageous reduction or elimination of charring and solidification of the adhesive 52.

Figure 5:
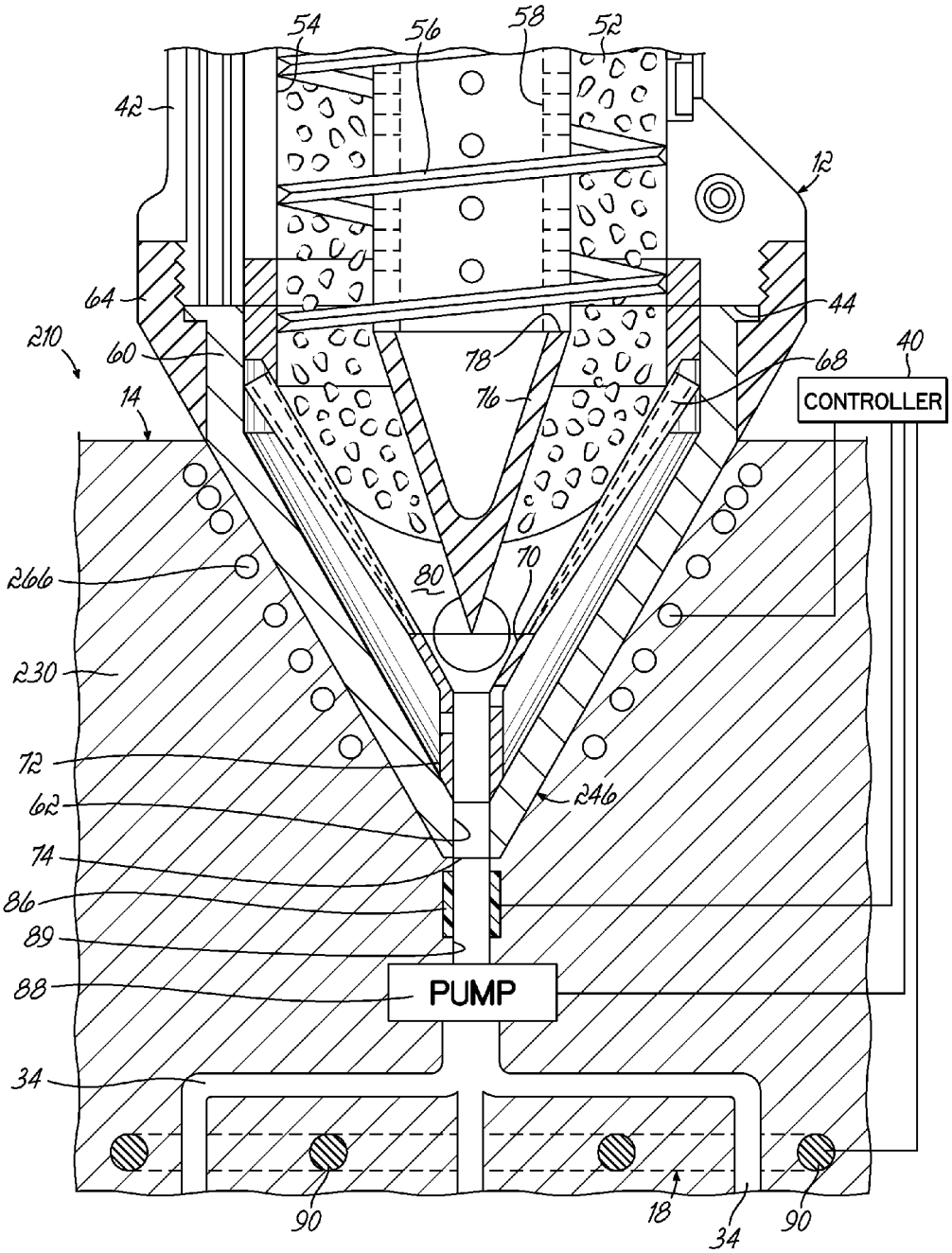
FIG. 5 is a cross-sectional front view of an alternative embodiment of the receiving device and the manifold, similar to the adhesive dispensing system of FIG. 3.

An alternative embodiment of the adhesive dispensing system 210 is shown in FIG. 5. Many of the components of this embodiment of the adhesive dispensing system 210 are identical or substantially similar to the components described above with reference to the embodiment shown in FIG. 3, and these components have been marked with the same reference numbers in this embodiment without additional explanation below. To this end, the adhesive dispensing system 210 includes the same receiving device 12 and dispensing applicator 14 as the first embodiment described above, but the manifold 230 and the nose assembly 246 have been modified in this embodiment to divide the first heating device 16 into a first portion within the manifold 230 and a second portion within the nose assembly 246. More specifically, the conical inductor 266 is moved to a location within the manifold 230 but still proximate to the conical susceptor 68, which remains in the nose assembly 246. As discussed above, the conical inductor 266 is an induction coil of wire that may be supplied with electrical current by the controller 40 to electromagnetically induce rapid heating of the conical susceptor 68 and the adhesive 52 within the susceptor 68. Although a first portion (inductor 266) is located within the manifold 230 and a second portion (susceptor 68) is located within the nose assembly 246, the first heating device 16 continues to operate in the same manner to rapidly melt adhesive 52 on demand, just like in the embodiments discussed above.

It will be understood that the first heating device 16 may include additional heating elements such as heater cartridges or other types of heating elements located in the manifold 230 to assist with the rapid and gentle melting of the adhesive 52 in other embodiments not illustrated. In still other embodiments consistent with the scope of this invention, the inductor 266 and susceptor 68 may be switched in position, or both located within the manifold 230. Regardless of the chosen layout of the first heating device 16, the first heating device 16 remains proximate to both the receiving device 12 and to the dispensing applicator 14 so that the adhesive 52 is melted at the point of application and on demand, thereby limiting the likelihood of charring or degradation of the adhesive 52.

Figure 6:
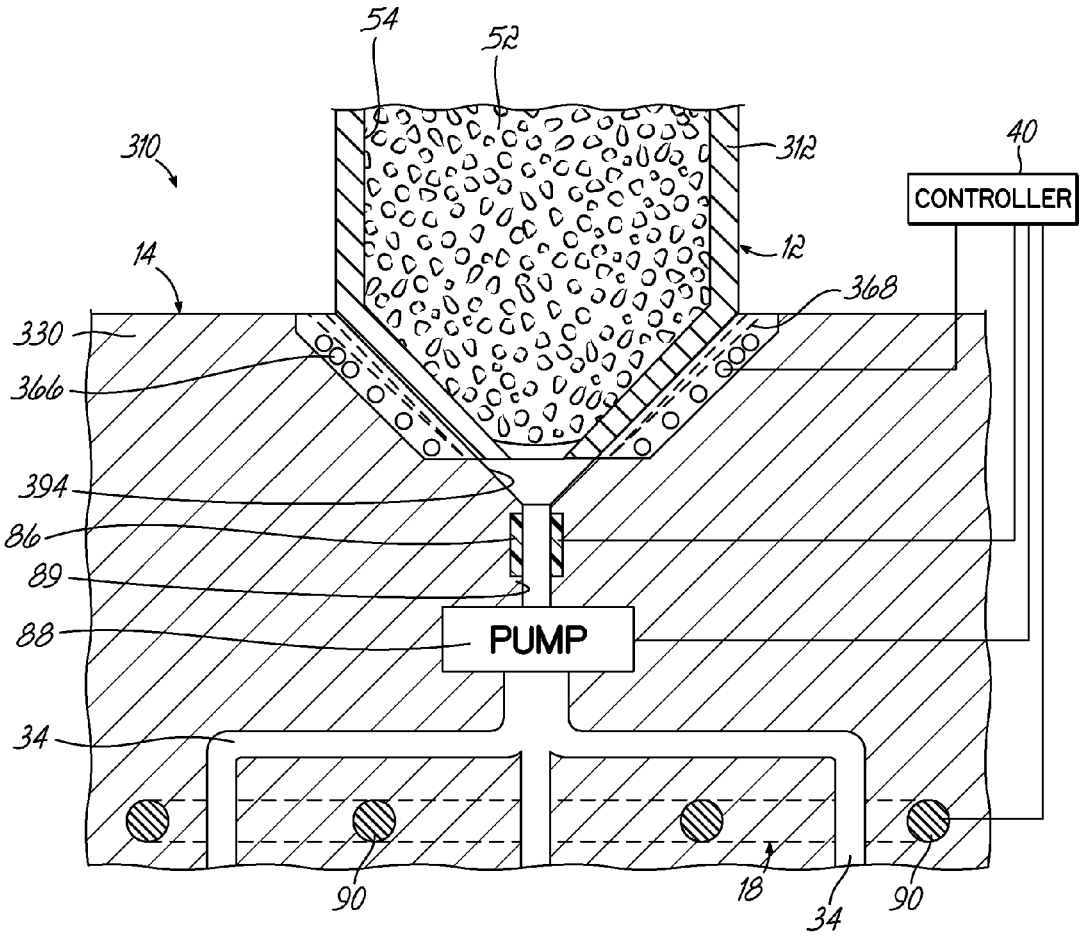
FIG. 6 is a cross-sectional front view of an alternative receiving device in the form of a cartridge and a manifold according to another embodiment of the adhesive dispensing system.

With reference to FIG. 6, an alternative embodiment of an adhesive dispensing system 310 including the latter type of arrangement discussed above is shown. More specifically, the first heating device 16 includes a conical inductor 366 in the form of an induction coil and a conical susceptor 368 each located within the manifold 330 near the entrance to the manifold passage. The adhesive dispensing system 310 contains many components that are identical or substantially similar to the components described above with reference to the other embodiments, and these components have been marked with the same reference numbers in this embodiment without additional explanation below.

In this embodiment, the manifold 330 is modified to include the first heating device 16, as described above, and a cartridge receptacle 394 formed adjacent to the conical inductor 366 and conical susceptor 368. It will be understood that other types of heating elements may be used for the first heating device 16 in other similar embodiments. For example, the inductor 366 and susceptor 368 may be divided with one in the cartridge 312 and one in the manifold 330 similar to FIG. 5, or with both elements 366, 368 in the cartridge 312 similar to FIG. 3, without departing from the scope of the current invention. The cartridge receptacle 394 communicates with the manifold passage 34 and is sized to closely receive a cartridge 312, which is the receiving device 12 in this embodiment. To this end, the cartridge 312 includes a hollow chamber (defining the receiving chamber 54) that is filled with solid adhesive 52 and generally gravity-feeds this solid adhesive 52 into a portion of the cartridge 312 that is nested within the cartridge receptacle 394 and located adjacent to the conical susceptor 368 in the manifold 330. Thus, the first heating device 16 is operable to rapidly heat the solid adhesive 52 located in the cartridge 312 at the cartridge receptacle 394 to melt that adhesive and supply it into the manifold passage 34 on demand. This melting operation is substantially identical (rapid and gentle) to the other melting operations described in detail above for the other embodiments. Similar to the previous embodiments, the manifold 330 continues to include the second heating device 18, which applies heat energy to keep the adhesive 52 in the liquid state within the manifold 330. As a result, this embodiment of the adhesive dispensing system 310 continues to achieve energy-efficient melt on demand operation with an advantageous reduction or elimination of charring and re-solidification of the adhesive 52.

The combination of a melt on demand process at the point of application using a first heating device 16 to rapidly melt the adhesive 52 and a second heating device 18 for maintaining the temperature of adhesive 52 located downstream from the receiving device 12 may be used in other embodiments with different sets of components other than those shown in the exemplary embodiments. For example, the dispensing applicator 14 may include some or all of the components described in the apparatus of U.S. Pat. No. 8,201,717 to Varga et al., which is co-owned by the assignee of the current application and the disclosure of which is hereby incorporated by reference in its entirety herein. Regardless of the particular structures used to define the receiving device 12 and the dispensing applicator 14, the melt on demand process enabled by the adhesive dispensing systems of the current invention advantageously addresses many of the drawbacks with conventional dispensing systems. The adhesive dispensing system maximizes the useful conversion of heat energy applied to the adhesive 52 while avoiding problems caused by solidification and charring of adhesive within a dispensing applicator.

While the present invention has been illustrated by a description of several embodiments, and while those embodiments have been described in considerable detail, there is no intention to restrict, or in any way limit, the scope of the appended claims to such detail. Additional advantages and modifications will readily appear to those skilled in the art. Therefore, the invention in its broadest aspects is not limited to the specific details shown and described. The various features disclosed herein may be used in any combination necessary or desired for a particular application. Consequently, departures may be made from the details described herein without departing from the spirit and scope of the claims which follow.

What is claimed is:

1. An adhesive dispensing system, comprising:

a dispensing applicator for dispensing an adhesive, said dispensing applicator including a manifold with a manifold passage and a dispensing module coupled to said manifold passage;

a receiving device positioned proximate to said dispensing applicator, said receiving device including a receiving chamber, which is configured to receive a small amount of solid adhesive at the location of said dispensing applicator, and an outlet that is positioned to deliver melted adhesive from said receiving device into said manifold immediately after melting;

a first heating device positioned proximate to said manifold and said receiving device, said first heating device operable to rapidly melt the small amount of solid adhesive in said receiving device on demand; and a second heating device positioned within said manifold and configured to apply heat energy to maintain the adhesive as a liquid in said manifold passage, wherein said receiving device includes a nose assembly defining said outlet, and a portion of said nose assembly nests at least partially into said manifold such that said outlet of said receiving device is located within said manifold and such that both of said first and second heating devices transmit heat energy to the adhesive within said portion of said nose assembly which is nested into said manifold, and wherein said first heating device is positioned adjacent said portion of said nose assembly which is nested into said manifold such that at least a portion of said first heating device extends into said manifold.

2. The dispensing system of claim 1, wherein said first heating device further comprises:

a susceptor positioned adjacent to said outlet of said receiving device; and an induction coil located proximate to said susceptor such that said induction coil electromagnetically induces said susceptor to heat and rapidly melt the adhesive.

3. The dispensing system of claim 1, wherein said manifold includes a cartridge receptacle communicating with said manifold passage, and wherein said receiving device is a cartridge filled with solid adhesive and inserted into said cartridge receptacle such that the solid adhesive may be rapidly melted by said first heating device.

4. The dispensing system of claim 1, wherein said first heating device is located within said manifold.

5. The dispensing system of claim 1, wherein said first heating device is located within said receiving device.

6. The dispensing system of claim 1, wherein said first heating device includes a first portion located within said receiving device and a second portion located within said manifold.

7. The dispensing system of claim 1, wherein said second heating device further comprises:

a heater cartridge extending through said manifold and configured to heat said manifold and said manifold passage.

8. The dispensing system of claim 1, wherein said second heating device FURTHER comprises:

an etched resistance heater positioned adjacent to said manifold passage and configured to heat said manifold passage.

9. An adhesive dispensing system, comprising:

a dispensing applicator for dispensing an adhesive, said dispensing applicator including a manifold with a manifold passage and a dispensing module coupled to said manifold passage;

a receiving device positioned proximate to said dispensing applicator, said receiving device including a receiving chamber, which is configured to receive a small amount of solid adhesive at the location of said dispensing applicator, and an outlet that is positioned to deliver melted adhesive from said receiving device into said manifold immediately after melting;

a first heating device positioned proximate to said manifold and said receiving device, said first heating device operable to rapidly melt the small amount of solid adhesive in said receiving device on demand; and a second heating device positioned within said manifold and configured to apply heat energy to maintain the adhesive as a liquid in said manifold passage, wherein said second heating device further comprises an etched resistance heater positioned adjacent to said manifold passage and configured to heat said manifold passage, wherein said etched resistance heater is positioned to define a sidewall of said manifold passage.

10. The dispensing system of claim 1, wherein said dispensing module further comprises a jetting module configured to rapidly jet minute droplets of adhesive from said jetting module.

11. The dispensing system of claim 1, wherein said dispensing applicator further comprises a metering pump communicating with said manifold passage, and wherein said dispensing module receives the adhesive from said metering pump.

12. The dispensing system of claim 1, further comprising:

a controller operatively connected to said first heating device, said second heating device, and said dispensing module; said controller operating said first and second heating devices to rapidly melt adhesive in said receiving device in response to actuations of said dispensing applicator to dispense adhesive such that a minimized amount of heat energy is applied to dispense the melted adhesive.

13. The dispensing system of claim 1, wherein the dispensing system is configured to:

supply solid adhesive to said receiving device;

rapidly heat the solid adhesive with said first heating device to melt the adhesive on demand;

deliver the melted adhesive directly from said receiving device into said manifold;

apply heat energy with said second heating device to maintain the melted adhesive as a liquid; and dispense the melted adhesive from said dispensing module.

* * * * *